US011512472B2

(12) United States Patent
Swaya, Jr.

(10) Patent No.: US 11,512,472 B2
(45) Date of Patent: Nov. 29, 2022

(54) ROOFING SYSTEMS AND METHODS

(71) Applicant: Thomas A. Swaya, Jr., Fort Myers, FL (US)

(72) Inventor: Thomas A. Swaya, Jr., Fort Myers, FL (US)

( * ) Notice: Subject to any disclaimer, the term of this patent is extended or adjusted under 35 U.S.C. 154(b) by 45 days.

(21) Appl. No.: 17/017,335

(22) Filed: Sep. 10, 2020

(65) Prior Publication Data

US 2021/0079655 A1 Mar. 18, 2021

Related U.S. Application Data

(60) Provisional application No. 62/899,508, filed on Sep. 12, 2019.

(51) Int. Cl.

| | |
|---|---|
| ***E04D 1/34*** | (2006.01) |
| ***E04D 1/24*** | (2006.01) |
| ***E04D 3/35*** | (2006.01) |
| ***E04D 1/30*** | (2006.01) |

(52) U.S. Cl.

CPC ..... *E04D 1/34* (2013.01); *E04D 1/24* (2013.01); *E04D 1/30* (2013.01); *E04D 3/351* (2013.01); *E04D 2001/309* (2013.01); *E04D 2001/3414* (2013.01); *E04D 2001/3458* (2013.01); *E04D 2001/3476* (2013.01); *E04D 2001/3491* (2013.01)

(58) Field of Classification Search

CPC .... E04D 1/34; E04D 1/24; E04D 1/30; E04D 3/351; E04D 2001/309; E04D 2001/3414; E04D 2001/3429; E04D 2001/3458; E04D 2001/347; E04D 2001/3476; E04D 2001/3491

USPC ..... 52/543, 551, DIG. 13

See application file for complete search history.

(56) References Cited

U.S. PATENT DOCUMENTS

| | | | | |
|---|---|---|---|---|
| 7,743,573 | B1 * | 6/2010 | Doberstein | E04D 1/28 52/518 |
| 8,915,030 | B2 * | 12/2014 | Boven | H02S 20/25 52/173.3 |
| 2006/0123727 | A1 * | 6/2006 | Akins | E04D 1/26 52/409 |
| 2014/0366470 | A1 * | 12/2014 | Edwards | E04D 1/30 52/302.1 |
| 2018/0347195 | A1 * | 12/2018 | Whitridge, Jr. | E04D 12/002 |

FOREIGN PATENT DOCUMENTS

| | | | | |
|---|---|---|---|---|
| WO | WO-9836139 | A1 * | 8/1998 | E04D 1/2918 |

* cited by examiner

*Primary Examiner* — William V Gilbert

(74) *Attorney, Agent, or Firm* — Quarles & Brady LLP

(57) ABSTRACT

A shingle assembly for installation on a roof structure is provided. The shingle assembly can include an insulative substrate, a surface sheet coupled to and extending across a substantial portion of the insulative substrate, and a hook-and-loop fastening system comprising a hook portion and a loop portion. The hook portion or the loop portion can be coupled to and extend along the insulative substrate adjacent the surface sheet. The other of the hook portion or the loop portion can be coupled to and extend along the surface sheet. The hook portion can be configured to mate with a loop portion of a first adjoining shingle assembly and the loop portion can be configured to mate with a hook portion of a second adjoining shingle assembly.

17 Claims, 5 Drawing Sheets

ROOFING SYSTEMS AND METHODS

RELATED APPLICATIONS

This application claims priority under 35 U.S.C 119 from U.S. Provisional Application No. 62/899,508, filed Sep. 12, 2019, which is incorporated herein by reference in its entirety.

BACKGROUND

There are various forms of roofing applications. For example, asphalt shingles are very common. Asphalt shingles are generally individually secured to the roof structure and overlap the previously installed, down-roof, shingle. Other forms of roofing include metal roofing, tile roofing, and cedar shake roofing. These other forms of roofing similarly include individual shingles that are individually secured to the roof structure and overlap the previously installed shingle.

SUMMARY

Some embodiments of the invention provide a shingle assembly that can be interlocked with other shingle assemblies to form a monolithic shingle system.

One aspect of the invention can provide a shingle assembly for installation on a roof structure. The shingle assembly can include an insulative substrate, a surface sheet coupled to and extending across a substantial portion of the insulative substrate, and a hook-and-loop fastening system comprising a hook portion and a loop portion. The hook portion or the loop portion can be coupled to and extend along the insulative substrate adjacent the surface sheet. The other of the hook portion or the loop portion can be coupled to and extend along the surface sheet. The hook portion can be configured to mate with a loop portion of a first adjoining shingle assembly and the loop portion can be configured to mate with a hook portion of a second adjoining shingle assembly.

Another aspect of the invention can provide a shingle system for installation on a roof structure. The shingle system can include a first shingle assembly, a second shingle assembly, and a third shingle assembly. Each of the first, second, and third shingle assemblies can include: an insulative substrate; a surface sheet coupled to and extending across a substantial portion of the insulative substrate; and a hook-and-loop fastening system comprising a hook portion and a loop portion. The hook portion or the loop portion can be coupled to and extend along the insulative substrate adjacent the surface sheet. The other of the hook portion or the loop portion can be coupled to and extend along the surface sheet. The hook portion or the loop portion of the first shingle assembly can be mated with the respective loop portion or hook portion of the second shingle assembly located down-roof from the first shingle assembly. The other of the hook portion or the loop portion of the first shingle assembly can be mated with the respective loop portion or the hook portion of the third shingle assembly located up-roof from the first shingle assembly.

Another aspect of the invention can provide a method of installing a shingle system on a roof structure. The method can include securing a first shingle assembly to the roof. The first shingle assembly can have a hook-and-loop fastening system comprising a hook portion and a loop portion. The method can further include securing a second shingle assembly to the roof up-roof from the first shingle assembly. The second shingle assembly can have a hook-and-loop fastening system comprising a hook portion and a loop portion. The method can also include securing one of the hook portion or the loop portion of the second shingle assembly to the respective loop portion or the hook portion of the first single assembly.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
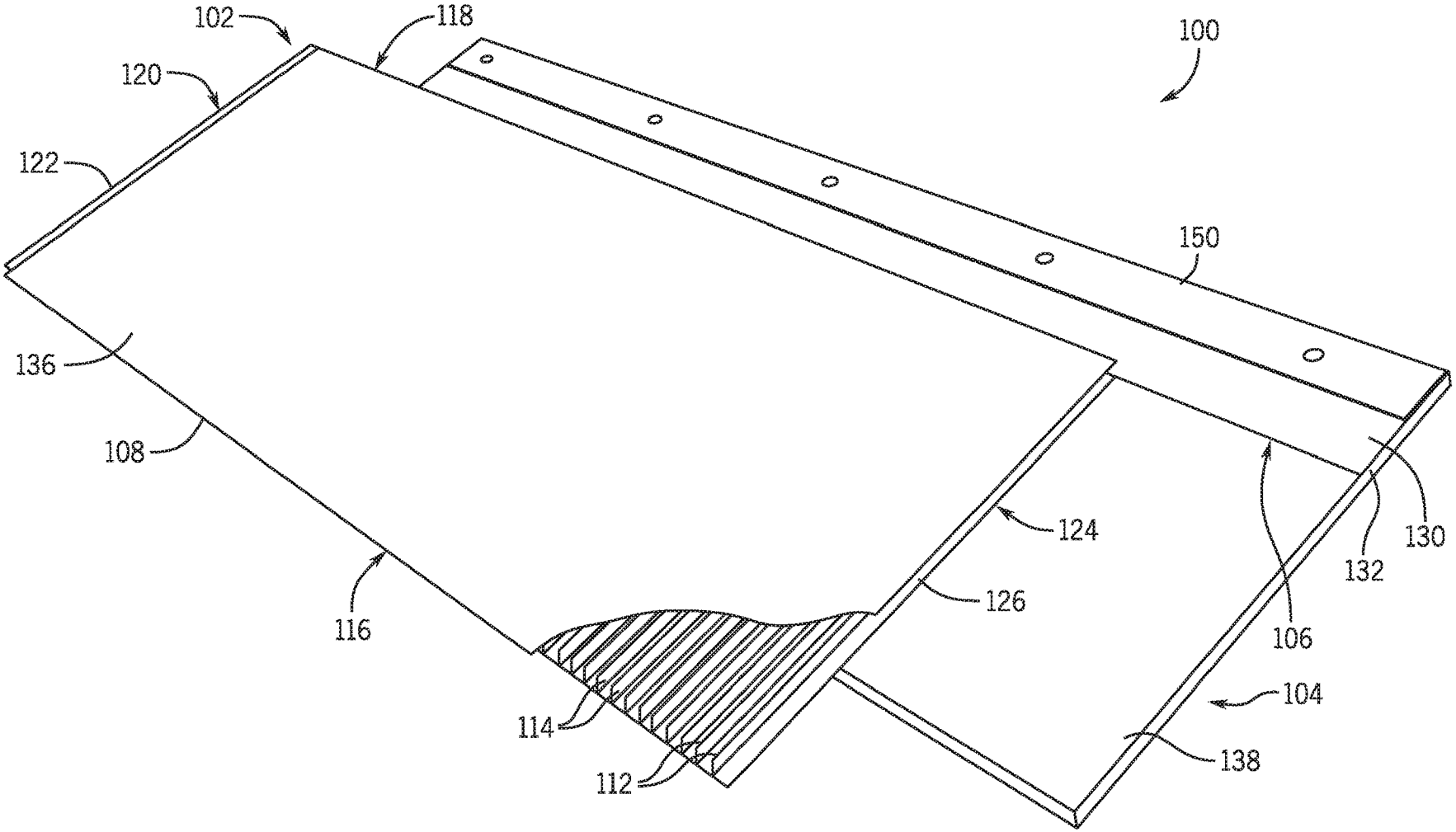
FIG. 1 is a front isometric view of a shingle assembly according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also as used herein, unless otherwise specified or limited, directional terms are presented only with regard to the particular embodiment and perspective described. For example, reference to features or directions as "horizontal," "vertical," "front," "rear," "left," "right," "upper," "lower," "top," "bottom," and so on are generally made with reference to a particular figure or example and are not necessarily indicative of an absolute orientation or direction. However, relative directional terms for a particular embodiment may generally apply to alternative orientations of that embodiment. For example, "front" and "rear" directions or features (or "right" and "left" directions or features, and so on) may be generally understood to indicate relatively opposite directions or features for a particular embodiment, regardless of the absolute orientation of the embodiment (or relative orientation relative to environmental structures). "Lateral" and derivatives thereof generally indicate directions that are generally perpendicular to a vertical direction for a relevant reference frame. Also, terms such as "down-roof" and "up-roof" generally indicate relative positions along the roof structure, with the roof peak being the highest point and the roof drip edge being the lowest, such that the roof drip edge is down-roof from the roof peak and the roof peak is up-roof from the roof drip edge.

Also as used herein, ordinal numbers are used for convenience of presentation only and are generally presented in an order that corresponds to the order in which particular features are introduced in the relevant discussion. Accordingly, for example, a "first" feature may not necessarily have any required structural or sequential relationship to a "second" feature, and so on. Further, similar features may be referred to in different portions of the discussion by different ordinal numbers. For example, a particular feature may be referred to in some discussion as a "first" feature, while a similar or substantially identical feature may be referred to in other discussion as a "third" feature, and so on.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As noted above, in some contexts, it may be useful to provide a shingle system comprising interlocking shingle assemblies. Embodiments of the invention can be useful in geographic areas prone to high winds, including those experienced in high velocity wind zones (e.g., winds up to and around 300 miles per hour). For example, embodiments of the invention can be interlocked with hook-and-loop fastening along adjoining sides for quick, tool-less interlocking vertically along roof structure. As another example, embodiments of the invention can include overlapping male and female portions along long lateral sides to ensure interlocking horizontally along a roof structure. Other examples can include arrangements of either or both interlocking male and female portions and hook-and-loop fastening along the sides of the shingle assemblies. In some embodiments, a shingle system can include at least one shingle assembly for each roof surface section.

In some embodiments, the shingle system can include a reflective surface configured to reflect the light from the Sun and reduce heat transfer to a roof structure. For example, a reflective coating may be applied to the shingle assembly. In some embodiments, the shingle assembly can be configured to allow airflow through the shingle assembly to aid in heat transfer. In some embodiments, channels formed within the shingle assembly can provide a path for airflow through the shingle assembly and through the shingle system. For example, air can move from a down-roof shingle assembly through up-roof shingle assemblies and out the roof peak.

In some embodiments, an insulative layer can be included in a shingle assembly to further limit heat from transferring from the environment to the roof structure below. In some embodiments, at least one radiant barrier can be included on the insulative layer. In some embodiments, a radiant barrier can be included on the top and the bottom of the insulative layer.

In some embodiments, the shingle assembly can be configured to withstand physical impact of wind-borne objects such as hail or other storm debris. In some embodiments, the shingle assembly can be configured to withstand the impact of falling objects such as falling tree limbs. In some embodiments, the shingle assembly can be configured to withstand the force of a person walking thereon.

Embodiments of the invention are presented below in the context of shingle assemblies and shingle systems for roofing. Generally, the principles disclosed herein can be used with any variety of roof, including pitched and flat roofs.

FIGS. 1-5 illustrate an embodiment of a shingle assembly 100 that can be used as part of a shingle system 10 (shown if FIG. 6) on a roof structure 12. As illustrated, the shingle assembly 100 has a surface sheet 102, an insulative substrate 104, and a hook-and-loop fastening system 106. The shingle assembly 100 can be configured to be sized depending on the installation requirements. For example, the shingle assembly 100 can be sized similar to that of a typical asphalt shingle of about 48 inches by 16 inches or can be provided in a larger format such as 24 inches by 30 feet. It should be understood that the shingle assembly 100 can be sized to any form factor desired, including sized to cover an entire roof section.

The surface sheet 102 is configured to be sturdy and capable of withstanding the impact of wind-borne objects, falling objects, and the weight of an adult human. For example, the surface sheet 102 can be formed from polycarbonate plastic. The surface sheet 102 has a top sheet layer 108, a bottom sheet layer 110, and walls 112 extending between and perpendicular to the top and bottom sheet layers 108, 110.

Figure 2:
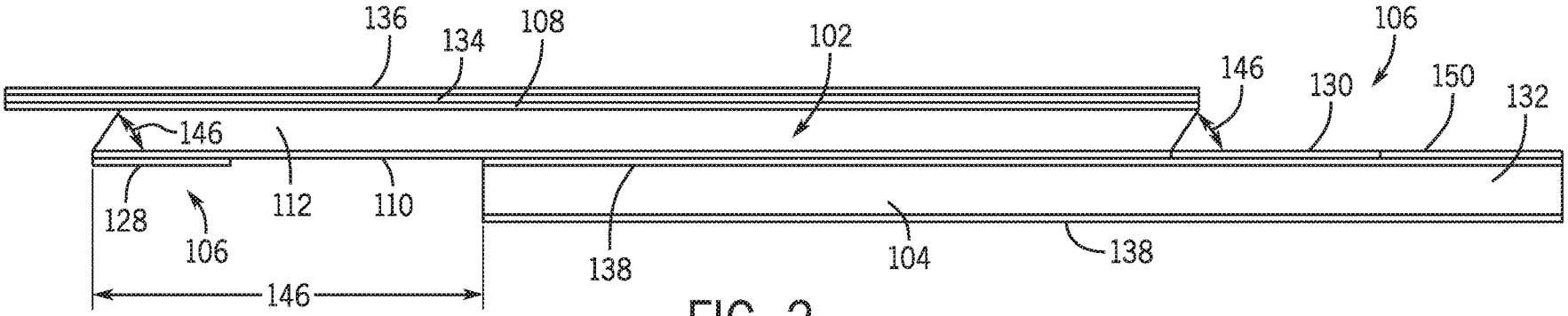
FIG. 2 is a right side elevation view of the shingle assembly of FIG. 1.

As shown in FIG. 2, the top sheet layer 108 extends beyond the bottom sheet layer 110 and the walls 112. This arrangement provides an overlapping element between connected shingle assemblies 100 of the shingle system 10, as discussed further below. Further, the down-roof and up-roof ends of the walls 112 are provided at an angle 146 relative to a plane defined by the roof structure 12. This arrangement can limit movement of a surface sheet of an up-roof shingle assembly from moving away the roof structure 12 during high wind event, for example, because there would be at least an interference contact between the walls of the up-roof surface sheet and the top sheet layer from a down-roof surface sheet. In installations in which the walls of the up-roof surface sheet and the down-roof surface sheet are aligned, the interference between the respective walls would be immediate and constant.

The top sheet layer 108, the bottom sheet layer 110, and the walls 112 define channels 114 extending from a first, or down-roof, end 116 to a second, or up-roof, end 118. The channels 114 provide airflow through the surface sheet 102. When the shingle system 10 is fully installed, the channels of multiple surface sheets can allow airflow from the roof drip edge 14 (shown in FIG. 4) or a lowest point on the roofing structure 12 to the roof peak 16 (shown in FIG. 5) or a higher point on the roofing structure 12. The airflow through the channels 114 acts as a self-venting element and can carry warm air up and toward the roof peak 16. Airflow through the channels 114 can also provide a negative pressure at the roof peak 18, or other final venting location, and aid in withdrawing warm air from an attic space that is vented at the roof peak 18. The channels 114 can also aid in directing any water or moisture trapped within the surface sheet 102 downward into a gutter system (not shown) attached at the roof drip edge 14. The cross-sectional dimensions of a channel 114 can be about ¾ inch by ¾ inch, but other cross-sectional dimensions are contemplated.

Figure 6:
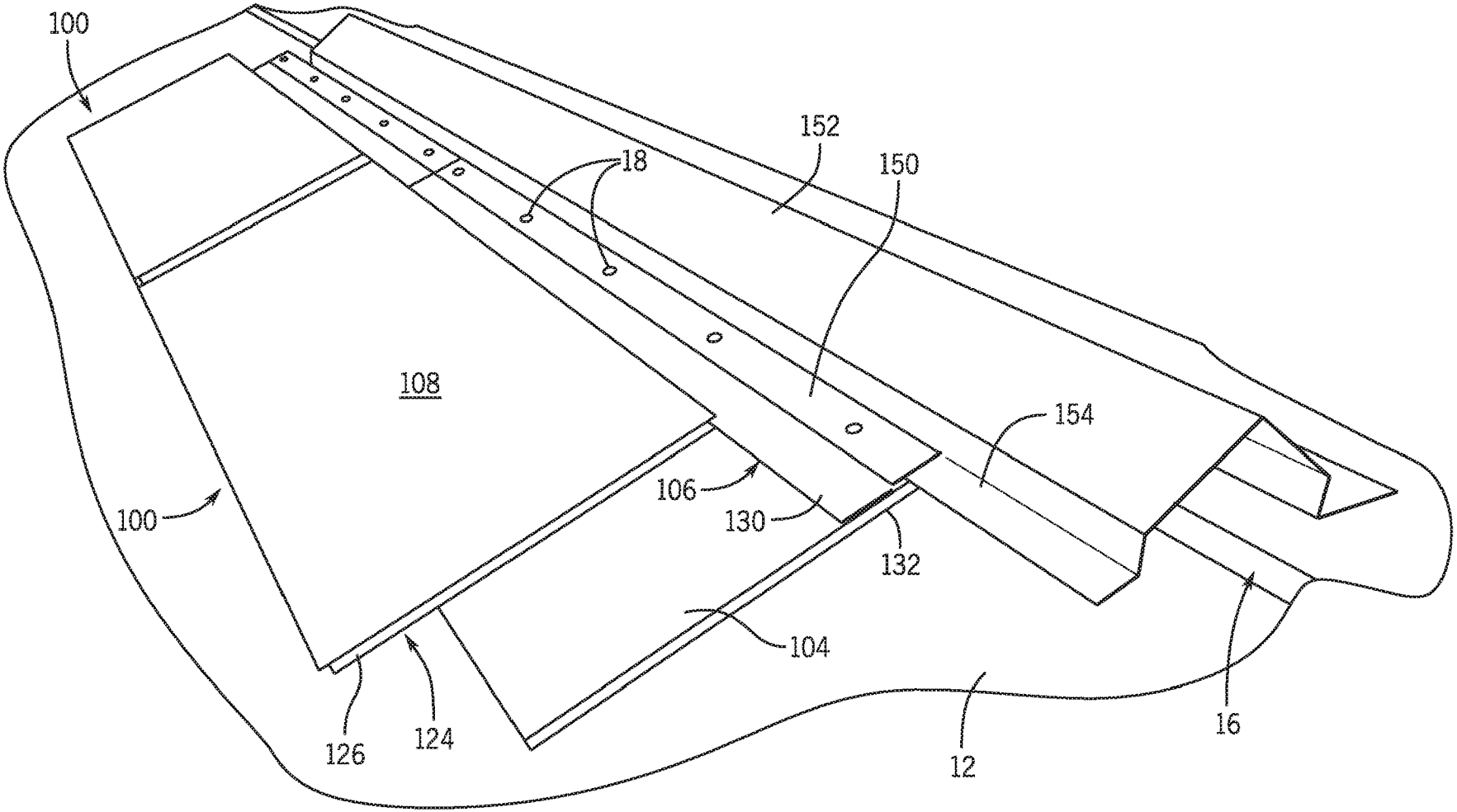
FIG. 6 is a front isometric view of a plurality of shingle assemblies of FIG. 1 installed on a roof forming a shingle system.

The surface sheet 102 is configured to interlock with other surface sheets laterally across a course of shingle assemblies 100 as shown in FIG. 6. A male portion 122 defined by at least one of the top and bottom sheet layers 108, 110 extends along a first lateral side 120 of the surface sheet 102. A female portion 126 defined by the top sheet layer 108, the bottom sheet layer 110, and a wall 112 extends along a second lateral side 124 of the surface sheet 102. The male end of one surface sheet being configured to be received within a female end of an adjacent surface sheet.

The insulative substrate 104 is configured to provide an insulative layer between the surface sheet 102 and the roof structure 12. It is contemplated that the insulative substrate 104 can be formed from polyisocyanurate closed-cell foam board. Other materials having similar, higher, or lower insulative characteristics are contemplated, however, and can depend on the use case. In some embodiments, the insulative substrate 104 can have a thickness of about ¾ inch, but other thicknesses are contemplated.

In the illustrated embodiment, the surface sheet 102 is coupled to and extends across a substantial portion of the insulative substrate 104. The coupling of the surface sheet 102 and the insulative substrate 104 can be achieved with an adhesive (not shown). The surface sheet 102 and the insulative substrate 104 have similar length and width dimensions. However, the positional relationship of the surface sheet 102 and the insulative substrate 104 is offset, with a portion of the second end 118 and a portion of the second lateral side 124 of the surface sheet 102 extending over the insulative substrate 104, the first end 116 laterally spaced beyond the insulative substrate 104 a first distance 146, and the first lateral side 120 laterally spaced beyond the insulative substrate 104 a second distance 148. Because the surface sheet 102 and the insulative substrate 104 have similar length and width dimensions, the insulative substrate 104 is exposed for a distance similar to the first distance 146 from the second end 118 of the surface sheet 102 and a distance similar to the second distance 148 from the second lateral side 124. The offset positional relationship ensures that joints between surface sheets and insulative substrates of adjacent shingle assemblies do not align. The offset positional relationship reduces the likelihood of water or other material from reaching the roof structure 12. The offset positional relationship also eliminates potential "hot spots" where aligned joints create areas in which heat from the sun can more easily reach the roof structure 12.

In some embodiments, it is contemplated that a portion of the bottom sheet layer 110 of the surface sheet 102 can extend along the top portion 132 of the insulative substrate 104 to aid in displacing the force of the fastening means, such as stainless steel panhead wood screws or roofing nails (not shown) along the top portion 132 of the insulative substrate 104 during installation, as discussed further below.

The hook-and-loop fastening system 106 includes a hook portion 128 and a loop portion 130. In some embodiments, the hook-and-loop fastening system 106 can be a marine-grade hook-and-loop fastening system. Either of the hook portion 128 or the loop portion 130 can be coupled to the insulative substrate 104 along a top portion 132 adjacent the second end 118 of the surface sheet 102. The other of the hook portion 128 or the loop portion 130 can be coupled to the bottom sheet layer 110 along the first end 116 of the surface sheet 102. The coupling of the hook portion 128 and the loop portion 130 to the surface sheet 102 and the insulative substrate 104 can be achieved through the use of adhesive, although other fastening means are contemplated.

The hook portion 128 and the loop portion 130 are sized and positioned to engage with respective hook and loop portions of adjacent shingle assemblies of down-roof and up-roof courses. The hook portion 128 of the shingle assembly 100 is configured to mate with a loop portion of a first adjoining shingle assembly, for example a down-roof shingle assembly, and the loop portion 130 of the shingle assembly 100 is configured to mate with a hook portion of a second adjoining shingle assembly, for example an up-roof shingle assembly. FIG. 6 illustrates the interconnection of a plurality of shingle assemblies 100 both laterally, up-roof, and down-roof.

Figure 3:
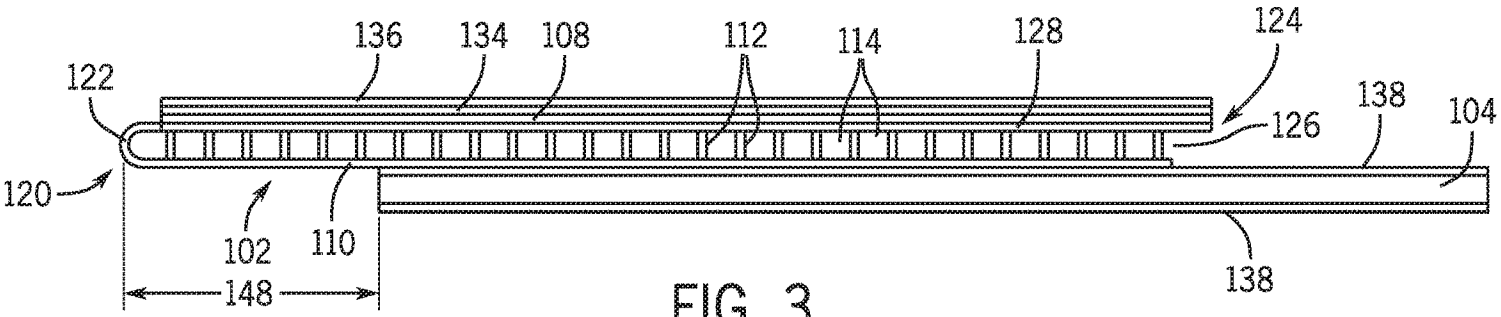
FIG. 3 is a front elevation view of the shingle assembly of FIG. 1.

The shingle assembly 100 can also include a wear layer 134 as shown in FIGS. 2 and 3. The wear layer 134 can extend across the top sheet layer 108 of the surface sheet 102. The wear layer 134 can be ethylene propylene diene monomer (EPDM) rubber or an equivalent rubber material. The wear layer 134 can be bonded to the top sheet layer 108 of the surface sheet 102. In some embodiments, the wear layer 134 can be applied to a thickness of about 1/16 inch. The wear layer 134 is configured to slowly wear from repeated exposure to environmental elements leaving the underlying surface sheet 102 substantially unharmed for many years. This not only extends the life of the surface sheet 102, but when the wear layer 134 requires rehabilitation, another layer of EPDM rubber can be applied instead of requiring the removal of the existing shingle assembly and replacement with a new shingle assembly.

In some embodiments, a reflective layer 136 can be provided in the shingle assembly 100. The reflective layer 136 can be applied to the top sheet layer 108 of the surface sheet 102 or the wear layer 134 if provided. The reflective layer 136 can be configured to reflect sunlight (including ultraviolet (UV) and infrared radiation) to reduce heat absorption by the shingle assembly 100. For example, the reflective layer 136 can be at least one of a reflective coating (e.g., paint) or a reflective film applied to the top sheet layer 108.

In some embodiments, at least one radiant barrier 138 can be provided in the shingle assembly 100. The radiant barrier 138 is configured to reduce heat transfer from the outdoor environment to the attic by preventing heat transfer from one side of the radiant barrier 138 to the other. The radiant barrier 138 can be formed from a material having a reflective, low emittance surface (e.g., a thin, mirror-like aluminum foil material). The radiant barrier 138 can be provided on at least one of the top or bottom surfaces of the insulative substrate 104. As shown in FIGS. 2 and 3, the radiant barrier 138 is provided on both the top and bottom surfaces of the insulative substrate 104.

In some embodiments, a metal strip 150 can be included in the shingle assembly 100. The metal strip 150 can be positioned along the top portion 132 of the insulative substrate 104 adjacent the hook portion 128 or the loop portion 130 of the hook-and-loop fastening system 106 positioned along the top portion 132 of the insulative substrate 104. The metal strip 150 can aid in displacing the force of the fastening means (not shown) along the top portion 132 of the insulative substrate 104 during installation, as discussed further below. In some embodiments, the metal strip 150 can be one inch wide and can be 22 gauge, for example.

In some implementations, devices or systems disclosed herein can be utilized or installed using methods embodying aspects of the invention. Correspondingly, description herein of particular features or capabilities of a device or system is generally intended to inherently include disclosure of a method of using such features for intended purposes and of implementing such capabilities. Similarly, express discussion of any method of using a particular device or system, unless otherwise indicated or limited, is intended to inherently include disclosure, as embodiments of the invention, of the utilized features and implemented capabilities of such device or system.

Figure 4:
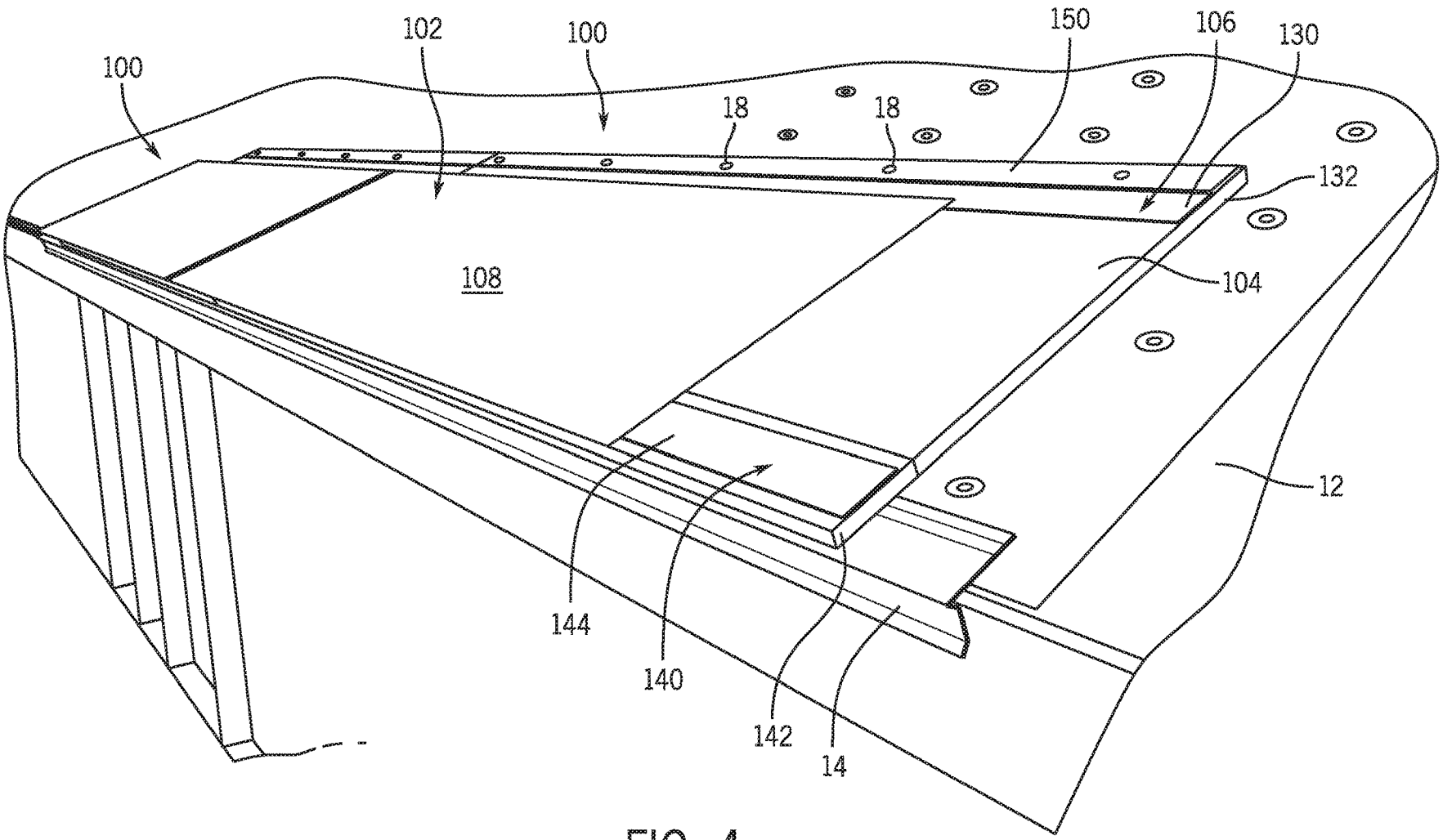
FIG. 4 is a front isometric view of the shingle assembly of FIG. 1 installed on a roof.
Figure 5:
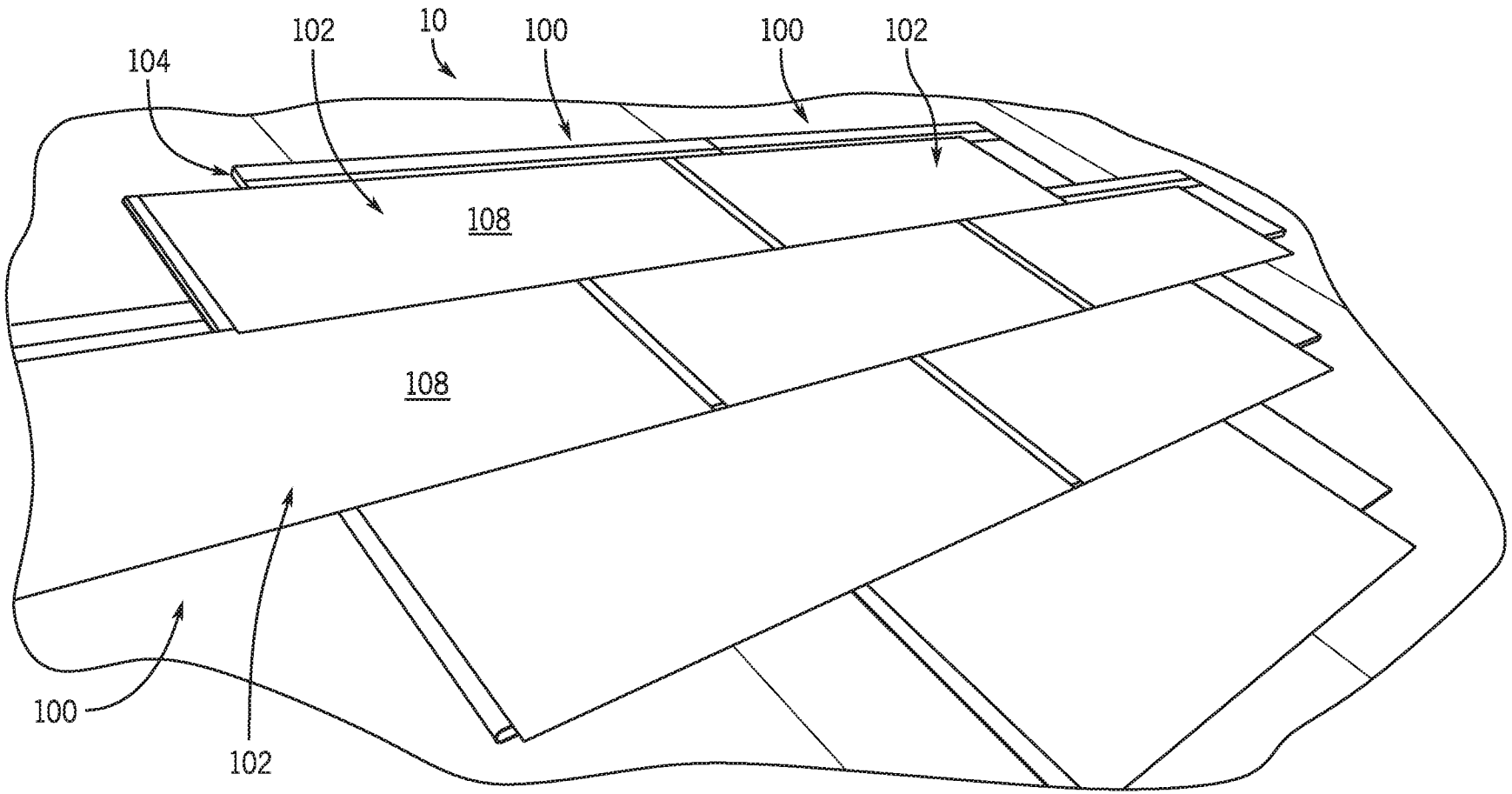
FIG. 5 is a front isometric view of the shingle assembly of FIG. 1 and a ridge cap.

For example, with reference to FIGS. 4-6 a user can install shingle assemblies 100 to a roof structure 12 to form a shingle system 10. A portion of starter course of shingle assemblies 100 is shown in FIG. 4. It is contemplated that a starter course panel 140 can be first installed along the roof drip edge 14. The starter course panel 140 can include an insulative substrate 142 of the same thickness of the insulative substrate 104 and a width of about the same as the first distance 146. The length of the starter course panel 140 can vary depending on application and can be greater than or less than the length the insulative substrate 104. A portion of a hook-and-loop fastening system 144 (e.g., a hook portion or a loop portion) is provided along the insulative substrate 142. The portion of a hook-and-loop fastening system 144 is configured to mate with the corresponding hook portion 128 or loop portion 130 of the hook-and-loop fastening system 106 coupled to the bottom sheet layer 110 of the surface sheet 102 of the shingle assembly 100. A metal strip (not shown) can also be provided along the top of the insulative substrate 142 and adjacent the portion of a hook-and-loop fastening system 144 to displace the force of the fastening means. In some embodiments, the metal strip (not shown) can be formed to further extend over the down-roof side of, and possibly continued underneath, the insulative substrate 142 to hide the down-roof side of the insulative substrate 142 from view. Fasteners (not shown) can be used to secure the starter course panel 140 along the roof drip edge 14.

A first shingle assembly 100 can then be installed. The corresponding hook portion 128 or loop portion 130 of the hook-and-loop fastening system 106 coupled to the bottom sheet layer 110 of the shingle assembly 100 is mated with the portion of a hook-and-loop portion 130 of the starter course panel 140. The shingle assembly 100 is secured to the roof structure with fasteners 18 received through the top portion 132 of the insulative substrate 104. Additional shingle assemblies 100 can that be installed laterally with respect to the shingle assembly 100 wherein the male and female portions 122, 126 of the first and second lateral sides 120, 124 are interlocked with respective male and female portions of first and second lateral sides of laterally adjacent shingle assemblies 100 to provide a first course of shingle assemblies 100.

A second course of shingle assemblies 100 can then be interlocked with the shingle assemblies 100 of the first course (an illustration of multiple courses of shingle assemblies 100 is shown in FIG. 6 for reference). The second course of shingle assemblies 100 are installed by overlapping the exposed portion of the insulative substrate 104 of the first course shingle assembly 100 with the portion of the surface sheet 102 that is spaced from the insulative substrate 104 of the second course shingle assembly 100 and interfacing the respective portions of the hook-and-loop fastening system 106. Further, a portion of the top sheet layer 108 of the second course shingle assembly 100 can overlap the top sheet layer 108 of the first course shingle assembly 100. The second course shingle assembly 100 is secured to the roof structure with fasteners 18 received through the top portion 132 of the insulative substrate 104. Similar to the first course, laterally adjacent shingle assemblies are interlocked to form the second course. Additional courses are installed similarly until coming within a course of the roof peak 16. It is contemplated that the shingle assemblies of the second course are staggered laterally with respect to the shingle assemblies of the first course and that subsequently installed up-roof courses are staggered from the preceding down-roof course.

As shown in FIG. 5, the top course of shingle assemblies 100 is installed along a ridge cap 152. The ridge cap 152 is shown for illustrative purposes and may take on additional forms to better integrate with the top course of shingle assemblies 100. Here the shingle assembly 100 is shown as interlocked with a flange 154 of the ridge cap 152 with both fastened to the roof structure 12 with fasteners 18. It is contemplated that the ridge cap 152 has openings configured to be in fluid communication with the channels 114 of the shingle assemblies 100 and the environment. Further, it is contemplated that a finish course panel (not shown) can be provided to engage with and cover the exposed top portion 132 of the insulative substrate 104. Moreover, the finish course panel could be incorporated with a ridge cap cover (not shown) that engages with shingle assemblies 100 on both sides of the roof peak 16 and the ridge cap 152 and is in fluid communication with the channels 114 of the shingle assemblies 100, the attic, and the environment.

Other elements of roof coverings such as metal flashings for roof hips and roof valleys (not shown) to be used in collaboration with the shingle system 10 are contemplated as being those that are currently existing. The metal flashings can be joined with the shingle system 10 with sealants, such as high-grade marine sealants.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. A shingle assembly for installation on a roof structure, the shingle assembly comprising:

an insulative substrate;

a surface sheet coupled to and extending across a substantial portion of the insulative substrate;

a hook-and-loop fastening system comprising a hook portion and a loop portion, wherein the hook portion or the loop portion is coupled to and extends along the insulative substrate adjacent the surface sheet and the other of the hook portion or the loop portion is coupled to and extends along the surface sheet, wherein the hook portion is configured to mate with a loop portion of a first adjoining shingle assembly and the loop portion is configured to mate with a hook portion of a second adjoining shingle assembly; and a metal strip extending along the insulative substrate adjacent the hook portion or the loop portion of the hook-and-loop fastening system coupled to the insulative substrate, the metal strip configured to receive fasteners for securing the shingle assembly to the roof.

2. The shingle assembly of claim 1, further comprising a wear layer bonded to the surface sheet.

3. The shingle assembly of claim 2, wherein the wear layer is ethylene propylene diene monomer (EPDM) rubber.

4. The shingle assembly of claim 2, further comprising a reflective coating applied to the wear layer.

5. The shingle assembly of claim 1, wherein the surface sheet is formed with channels, the channels configured to allow airflow through the surface sheet.

6. The shingle assembly of claim 1, wherein the insulative substrate is formed from polyisocyanurate closed-cell foam board.

7. The shingle assembly of claim 1, further comprising a radiant barrier extending along the insulative substrate and between the surface sheet and the insulative substrate.

8. A shingle system for installation on a roof structure, the shingle system comprising:

a first shingle assembly, a second shingle assembly, and a third shingle assembly, each including:

an insulative substrate;

a surface sheet coupled to and extending across a substantial portion of the insulative substrate; and a hook-and-loop fastening system comprising a hook portion and a loop portion, wherein the hook portion or the loop portion is coupled to and extends along the insulative substrate adjacent the surface sheet and the other of the hook portion or the loop portion is coupled to and extends along the surface sheet;

wherein the hook portion or the loop portion of the first shingle assembly is mated with the respective loop portion or hook portion of the second shingle assembly located down-roof from the first shingle assembly and the other of the hook portion or the loop portion of the first shingle assembly is mated with the respective loop portion or the hook portion of the third shingle assembly located up-roof from the first shingle assembly; and wherein each of the first, second, and third shingle assemblies has a male portion and a female portion on opposing first and second lateral sides, the male and female portions configured to interface with respective female and male portions of laterally positioned shingle assemblies.

9. The shingle system of claim 8, wherein the first, second, and third shingle assemblies are arranged in a staggered pattern.

10. The shingle system of claim 8, wherein the surface sheet of the first shingle assembly overlaps the surface sheet of the second shingle assembly and the surface sheet of the third shingle assembly overlaps the surface sheet of the first shingle assembly.

11. The shingle system of claim 8, wherein the surface sheets of each of the first, second, and third shingle assemblies are formed with channels;

wherein the ventilation channels of each of the first, second, and third shingle assemblies are configured to allow airflow through the shingle system.

12. The shingle system of claim 11, further including a starter course panel, the starter course panel configured to be installed along a roof drip edge and coupled to the second shingle assembly.

13. The shingle system of claim 8, wherein each of the first, second, and third shingle assemblies include a wear layer bonded to the surface sheet.

14. The shingle system of claim 13, further comprising a reflective coating applied to the wear layer.

15. The shingle system of claim 8, further comprising a radiant barrier extending along the insulative substrate and between the surface sheet and the insulative substrate of each of the first, second, and third shingle assemblies.

16. The shingle system of claim 8, wherein each of the first, second, and third shingle assemblies further includes a metal strip coupled to and extending along the insulative substrate adjacent the hook portion or the loop portion of the hook-and-loop fastening system coupled to the insulative substrate, the metal strip configured to receive fasteners for securing the first, second, and third shingle assemblies to the roof structure.

17. A shingle assembly for installation on a roof structure, the shingle assembly comprising:

an insulative substrate;

a surface sheet coupled to and extending across a substantial portion of the insulative substrate;

a hook-and-loop fastening system comprising a hook portion and a loop portion, wherein the hook portion or the loop portion is coupled to and extends along the insulative substrate adjacent the surface sheet and the other of the hook portion or the loop portion is coupled to and extends along the surface sheet, wherein the hook portion is configured to mate with a loop portion of a first adjoining shingle assembly and the loop portion is configured to mate with a hook portion of a second adjoining shingle assembly; and a radiant barrier extending along the insulative substrate and between the surface sheet and the insulative substrate.

* * * * *